United States Patent [19]

Barrat et al.

[11] 4,111,855

[45] Sep. 5, 1978

[54] LIQUID ENZYME CONTAINING DETERGENT COMPOSITION

[75] Inventors: Christian Roland Barrat, Meise; José Luis Arnau, Wermel; Jean Wevers, Brussels, all of Belgium

[73] Assignee: The Procter & Gamble Company, Cincinnati, Ohio

[21] Appl. No.: 775,213

[22] Filed: Mar. 7, 1977

[30] Foreign Application Priority Data

Mar. 8, 1976 [GB] United Kingdom ..... 9258/76
Dec. 9, 1976 [GB] United Kingdom ..... 51465/76

[51] Int. Cl.[2] ..... C11D 1/831; C11D 3/36

[52] U.S. Cl. ..... 252/545; 252/153; 252/554; 252/558; 252/559; 252/DIG. 11; 252/DIG. 12; 252/DIG. 14; 252/DIG. 17

[58] Field of Search ..... 252/89, 554, 545, 558, 252/559, DIG. 11, DIG. 12, DIG. 14, DIG. 17

[56] References Cited

U.S. PATENT DOCUMENTS

| | | | |
|---|---|---|---|
| 3,627,688 | 12/1971 | McCarty | 252/153 |
| 3,634,266 | 1/1972 | Theile et al. | 252/132 |
| 3,676,374 | 7/1972 | Zaki et al. | 252/551 |
| 3,819,528 | 6/1974 | Berry | 252/153 |
| 3,860,536 | 1/1975 | Landwerlen et al. | 252/551 |
| 3,931,033 | 1/1976 | Lohr et al. | 252/122 |
| 3,933,672 | 1/1976 | Bartolotta et al. | 252/116 |
| 4,021,377 | 5/1977 | Borhert et al. | 252/546 |

FOREIGN PATENT DOCUMENTS

| | | |
|---|---|---|
| 2,038,103 | 10/1972 | Fed. Rep. of Germany. |
| 7,105,204 | 10/1971 | Netherlands. |

*Primary Examiner*—P.E. Willis, Jr.

[57] ABSTRACT

The present invention pertains to liquid homogeneous substantially unbuilt enzyme containing detergent compositions. These liquid compositions contain a major amount of a surfactant mixture comprising an ethoxylated nonionic surfactant and a synthetic anionic surfactant, a low level of a polyacid, free calcium ions, a proteolytic enzyme and a liquid carrier. The liquid compositions of this invention are from a performance standpoint comparable to granular built heavy duty detergent compositions. In respect to the comparable known liquid detergent state of the art, the compositions herein are capable of providing superior cleaning performance and excellent storage stability, particularly as regards the enzymatic activity.

6 Claims, No Drawings

LIQUID ENZYME CONTAINING DETERGENT COMPOSITION

BACKGROUND OF THE INVENTION

1. Field of the Invention

The present invention pertains to liquid homogeneous substantially unbuilt enzyme containing detergent compositions.

2. Description of the Art

To be satisfactory for washing or pre-treating and subsequent washing of heavily soiled fabrics, such as cotton and synthetic fabrics, liquid detergent compositions contain an adequate concentration of detergent compounds. In addition, they must remain stable and homogeneous when subjected to various storage conditions and be designed for use in both horizontal (tumble drum type) and upright (vertical agitator type) washing machines and for topical application as well as for hand-washing.

Liquid, heavy duty detergent compositions a synthetic organic detergent compound, which is generally anionic, nonionic or mixed anionic-nonionic in nature; an inorganic builder salt; and a solvent, are disclosed, for example, in U.S. Pat. Nos. 2,551,634; 2,908,651; 2,920,045; 2,947,702; 3,239,468; 3,272,753; 3,393,154; 3,554,916; 3,697,451; 3,709,838; Belgian patents 613,165; 665,532; 794,713 and 817,267; British Pat. No. 759,877; 842,813; and German application Nos. 1,617,119; 1,937,682; 2,327,861; 2,330,840; 2,361,448 and 2,362,114. These compositions frequently contain a hydrotrope or solubilizing agent to permit the addition of sufficient quantities of surfactants and usual builder salts to provide a reasonable volume usage/performance ratio. Others are substantially anhydrous liquid compositions containing an alkanolamine component (U.S. Pat. No. 3,528,925). Still others contain a soap component (U.S. Pat. Nos. 2,875,153 and 2,543,744).

It is well-known that the formulation of enzyme containing liquid detergent compositions is a very delicate task due to the rapid decrease of the enzymatic activity in aqueous medium during storage. In fact, the difficulties flowing from the inherent losses in enzymatic activity are such that until now, this problem could not be solved satisfactorily. The significance of these obstacles will even be better understood when considering that the desirability for formulating liquid detergent compositions containing enzymes is known for a good time already. The absence of any practical solution to this highly unsatisfactory enzymatic activity retention in aqueous detergent medium confirms all the more, both, the instability of enzymes in current liquid detergents compositions and concomitantly the difficulties for selectively formulating a liquid composition containing enzymes which might be of commercial interest.

The state of the art is scattered in respect to this particular aspect of detergent technology. So, for example, it is known from Dutch patent application No. 66.08106 that proteolytic enzymes do only have a limited stability in aqueous medium. In addition to this, it is expressed that most detergent ingredients such as phosphates, carbonates, and sulfates have an adverse effect on the activity of these enzymes as well as on their stability in detergent solution. This reference amounts to an explanation why (proteolytic) enzymes are until now only incorporated into granular detergent compositions. No concrete solution however is suggested in the art relative to the deficient stability.

From the discosures of "BIOCHEMICA ET BIOPHYSICA ACTA," Vol. 6 (1950), pages 237 et seq., is known that sequestering agents in general exert a destabilizing effect on proteolytic enzymes in aqueous medium. Citric acid, oxalic acid, ethylenediaminetetracetic acid, and nitrilotrilotriacetic acid examplify this known destabilizing effect. German patent application DOS No. 2,301,728 is representative of the known prior art. It discloses that various enzyme preparations can be incorporated into liquid detergent compositions preferably in conjunction with detergent sequestering builders.

As can be seen from the foregoing, a substantial effort has been expanded in developing built and builder-free detergent compositions in liquid form. Yet, there are several problems associated with the art-disclosed compositions which render them less optimal for wide scale use, undesirable from an ecological standpoint in improperly treated sewage, objectionable from a performance point of view in cleaning both natural and synthetic fibers and subject to deactivation of the enzyme component during storage.

It has now been found that these known deficiencies can be avoided by formulating enzyme containing liquid detergent compositions' comprising a minor amount of a specific polyacid and a certain level of free calcium ions.

It has also been found that liquid, concentrated, heavy duty detergent compositions containing a major amount of a mixture of a polyethoxylated nonionic and a synthetic anionic surfactant in conjunction with a polyacid, a protease and the free calcium ions and having a pH in the range of from 6.0 to 7.5, exhibit superior removal of bleach-sensitive stains by topical application and through-the-wash fabric cleaning.

These liquid, concentrated, heavy duty detergent compositions exhibit good physical properties, remain hoogeneous and stable under severe storage conditions and stand the addition of many usual adjuvants.

It is an object of this invention to provide liquid, concentrated, homogeneous, stable enzyme containing heavy duty detergent compositions which exhibit excellent cleaning and superior bleach-sensitive stain removal by topical application and through-the-wash fabric cleaning.

It is another object herein to provide liquid, concentrated, homogeneous, stable, heavy duty detergent compositions which retain an effective enzyme activity under prolonged storage conditions.

It is still another object herein to provide liquid, concentrated, homogeneous, stable, enzyme containing heavy duty detergent compositions acceptable from an ecological standpoint.

These and other objects can now be met as will be seen from the following disclosure.

SUMMARY OF THE INVENTION

The liquid compositions claimed herein comprise:

(a) from about 35% to about 75% by weight of a surfactant mixture comprising an ethoxylated nonionic surfactant and a synthetic anionic surfactant wherein the weight ratio of said nonionic surfactant to said anionic surfactant is in the range from about 1:1 to about 5:1;

(b) from 0.05% to about 1.5% by weight of a polyacid capable of forming water-soluble Ca-complexes;

(c) from 0.5 millimole/liter to 15 millimoles/liter of free calcium ions;

(d) from 0.001% to about 2% of an alkaline proteolytic enzyme having an iso-electric point of greater than about 8;

(e) a liquid carrier comprising water and from about 2% to about 15% by weight of the total composition of a lower aliphatic alcohol;

the pH of the composition being within the range from about 6.0 to about 7.5.

In a preferred embodiment, the polyacid is present in an amount from 0.05% to 1.0% by weight, wherein said polyacid is capable of providing an enzyme stability which is about equivalent to the enzyme stability provided by adding from 0.3% to 0.6%, preferably 0.5% by weight citric acid, said stability for the polyacid and the citric acid being determined in substantially identical compositions of this invention.

The logarithmic value of the stability constant of the Ca-complexes of the polyacid is preferably greater than 1.5, most preferably between 2.0 and 4.0 at the pH of the composition.

The term "free calcium ion" or "calcium ion" as used herein is meant to express calcium not bound by the polyacid (sequestering agent).

DETAILED DESCRIPTION OF THE INVENTION

The essential components herein are described in more details hereinafter.

Unless indicated to the contrary, the percentage indications stand for percent by weight.

The Ethoxylated Nonionic Surfactant

The ethoxylated nonionic surfactant can be represented by all detergent ethoxylates which are known to be suitable for use in detergent technology. Such nonionic compounds are conventionally produced by condensing ethylene oxide, forming the hydrophilic moiety orethenoxy chain, with a hydrocarbon having a reactive hydrogen atom, e.g., a hydroxyl-, carboxyl-, or amino group, and forming the hydrophobic moiety, in the presence of acidic or basic catalysts. Such procedures result in the production of a product mixture comprising a number of nonionics of varying ethoxylate content. Therefore, the conventional designation of the number of ethylene oxide units "*m*" present per molecule of nonionic compound as designated, for example, in the general formula $R\text{-}A(CH_2CH_2O)_mH$, wherein R represents the hydrophobic moiety and A the group carrying the reactive hydrogen atom, is an indication of the average number of ethylene oxide units per molecule of nonionic compound according to a statistical distribution where the peak is situated around the "*m*" number.

The properties of the ethoxylated nonionic surfactants depend to a considerable extent on the hydrophilic moiety, i.e. the average number of ethylene oxide units present. Most commercially available ethoxylated nonionics are viscous liquids or soft pastes having in general from about 2 to about 24 ethylene oxide units in average.

The ethoxylated nonionic surfactants useful in the compositions of the present invention include preferably those compounds which are obtained by reacting an alcohol with ethylene oxide and which are soluble in the instant liquid compositions.

Ethoxylated nonionic surfactants have a negative temperature coefficient of solubility in water, becoming less soluble at higher temperatures. Therefore, soluble in the instant liquid compositions means soluble at temperatures below about 35° C.

Usually the ethoxylated nonionic surfactants are considered to include only those compounds which are soluble in water. There is a large number of ethoxylated nonionic surfactants having detersive properties but which do not have enough hydrophilic character to be fully soluble in water but are dispersible in water. They can be solubilized in water, however, with the help of solubilizing agents such as lower aliphatic alcohols, by admixing highly soluble ethoxylated nonionic compounds or by hydrotropes. Therefore, soluble in the instant liquid compositions means soluble per se in water or soluble in the instant liquid composition.

The hydrophobic moiety of the nonionic compounds useful in the composition of the present invention can be derived from primary and secondary, straight or branched, saturated or unsaturated aliphatic alcohols having from about 8 to about 24, preferably from about 12 to about 20 carbon atoms. Another source is the alkylphenols wherein the alkyl group or groups have from 1 to about 12 carbon atoms, wherein at least one group has at least 6 carbon atoms and the total number of carbon atoms in the alkyl groups is at most about 15.

Primary alcohols can be derived from animal and vegetable oils and fats by, for example, hydrogenolysis of said oils, fats or corresponding fatty acids. They are substantially straight-chain or linear alcohols.

Primary alcohols can also be obtained from synthetic sources by different processes. The usual raw materials are polymers of lower alkylenes or olefins. According to the type of polymers, olefins, processes and process conditions, alcohols with a different degree of linearity or branching are obtained. The major part of the commercially available primary synthetic alcohols are prepared by either the "OXO" or "Ziegler" process.

Secondary alcohols are mostly obtained from synthetic sources, e.g., from olefins, either by direct hydration at high temperatures and pressures or hydrolysis of the intermediate sulfuric acid product; by oxidation of paraffins, etc.

Alkylphenols are obtained by reacting a phenol with an olefin thermally preferably in the presence of a catalyst, e.g., boron trifluoride. Xylenol and cresol can also be used instead of phenol.

Preferred for the compositions of the present invention are polyethoxylated nonionics derived from primary and secondary aliphatic alcohols.

The hydrophilic moiety of the nonionic compounds useful in the composition of the present invention is an ethenoxy chain consisting of from 2 to about 24 ethylene oxide units in average, depending upon hydrophobic character of the hydrocarbon group. Preferred are those ethenoxy chains containing at least about 4 ethylene oxide units.

Suitable examples of ethoxylated nonionic surfactants can, for example, be prepared from aliphatic primary alcohols containing from 12 to 20 carbon atoms condensed with from about 4 moles to about 14 moles of ethylene oxide per mole of alcohol. Nonlimiting, specific examples of ethoxylated nonionic surfactants derived from straight chain primary aliphatic alcohols are:

$C_{12}H_{25}\text{-}O\text{-}(C_2H_4O)_6\text{-}H$;
$C_{16}H_{33}\text{-}O\text{-}(C_2H_4O)_9\text{-}H$;
$C_{18}H_{35}\text{-}O\text{-}(C_2H_4O)_9\text{-}H$;
$C_{18}H_{37}\text{-}O\text{-}(C_2H_4O)_9\text{-}H$;
$C_{14}H_{29}\text{-}O\text{-}(C_2H_4O)_9\text{-}H$;

$C_{12}H_{25}$-O-$(C_2H_4O)_9$-H;
$C_{12}H_{25}$-O-$(C_2H_4O)_4$-H;
$C_{16}H_{33}$-O-$(C_2H_4O)_9$-H;
tallow-O-$(C_2H_4O)_{11}$-H;
$C_{11}H_{23}$-O$(C_2H_4O)_4$-H;
$C_{16}H_{33}$-O$(C_2H_4O)_7$-H;

and mixtures thereof. Non-limiting, specific examples of ethoxylated nonionic surfactants derived from secondary aliphatic alcohols are:

$C_{12}H_{25}CH(C_4H_9)$-O-$(C_2H_4O)_9$-H;
$C_8H_{17}CH(C_4H_9)$-O-$(C_2H_4O)_{12}$-H;
$(C_7H_{15})_2CH$-O-$(C_2H_4O)_6$-H;
$C_{17}H_{35}CH(CH_3)$-O-$(C_2H_4O)_9$-H;
$C_{14}H_{29}CH(C_3H_7)$-O-$(C_2H_40)_9$-H;
$C_{14}H_{29}CH(CH_3)$-O-$(C_2H_4O)_9$-H;

and mixtures thereof. Nonlimiting, specific examples of ethoxylated nonionic surfactants derived from branched primary aliphatic alcohols are:

$C_{10}H_{21}CH(CH_3)CH_2$-O-$(C_2H_4O)_9$-H;
$C_{12}h_{25}$-$CH(CH_3)CH_2$-O-$(C_2H_4O)_{11}$-H;
$C_{15}H_{31}CH(CH_3)CH_2$-O-$(C_2H_4O)_9$-H;
$C_{13}H_{27}CH(CH_3)CH_2$-$CH_2$-$CH_2$-O-$(C_2H_4O)_9$-H;
$C_{12}H_{25}CH(C_2H_5)$-$CH_2$-O-$(C_2H_4O)_9$-H;
$(C_7H_{15})_2CH$-$CH_2$-O-$(C_2H_4O)_{12}$-H;
$C_9H_{19}CH(C_8H_{17})CH_2$-O-$(C_2H_4O)_{12}$-H;
$C_{13}H_{27}CH(C_4H_9)CH_2$-O-$(C_2H_4O)_{11}$-H;
$C_{13}H_{27}CH$-$(C_3H_7)CH_2$-$CH_2$-O-$(C_2H_4O)_9$-H, and mixtures thereof. Non limiting, specific examples of ethoxylated nonionic surfactants derived from alkylphenols are $C_9H_{19}C_6H_4$-O-$(C_2H_4O)_9$-H;
$C_{12}H_{25}C_6H_4$-O-$(C_2H_4O)_{12}$-H;
$(C_9H_{19})(CH_3)C_6H_3$-O-$(C_2H_4O)_{12}$-H;
$(C_{12}H_{25})(CH_3)_2C_6H_2$-O-$(C_2H_4O)_{11}$-H;
$C_{12}H_{25}C_6H_4$-O-$(C_2H_4O)_6$-H;

and mixtures thereof. Non-limiting, specific examples of mixtures of ethoxylated nonionic surfactants consisting of slightly water-soluble and highly water-soluble nonionics useful in the compositions of the present invention are:

½ mixture of $C_{12}H_{25}$-O-$(C_2H_4O)_5$-H and $C_{12}H_{25}$-O-$(C_2H_4O)_{12}$-H;
1/1 mixture of $C_{14}H_{29}$-O-$(C_2H_4O)_5$-H and tallow-O-$(C_2H_4O)_{11}$-H;
2/1 mixture of $C_{15}H_{31}$-O-$(C_2H_4O)_7$-H and tallow-O-$(C_2H_4O)_{11}$-H;
1/4 mixture of $C_{10}H_{21}$-O$(C_2H_4O)_3$-H and $C_{13}H_{27}CH(CH_3)CH_2$-O-$(C_2H_4O)_{10}$-H;
1/1/1 mixture of $C_8H_{17}CH(C_6H_{13})$-O-$(C_2H_4O)_6$-H; $C_{12}H_{25}CH(CH_3)CH_2$-O-$(C_2H_4O)_4$ and $C_{18}H_{37}$-O-$(C_2H_4O)_{15}$-H;
0.2/1/2 mixture of $C_9H_{19}C_6H_4$-O-$(C_2H_4O)_9$-H; $C_{15}H_{31}$-O$(C_2H_4O)_5$-H and $C_{18}H_{37}$-O-$(C_2H_4O)_{12}$-H;
2/1/1 mixture of $(CH_3)_3C(CH_2)_8CH_2$-O-$(C_2H_4O)_3$-H; $C_{16}H_{33}CH(CH_3)CH_2$-O-$(C_2H_4O)_{11}$-H and $C_{14}H_{29}CH(CH_3)$-O-$(C_2H_4O)_9$-H (all ratios being by weigh).

A particularly preferred ethoxylated nonionic surfactant is represented by a mixture of: (1) a primary alcohol ethoxylate obtained from an alcohol, the hydrocarbon chain of which contains at least 65% branched-chain structure and is obtained by hydroformylation of random olefins and has from about 14 to about 22, especially from 16 to 19 carbon atoms in the hydrocarbyl chain, and 8 to 14 moles of ethylene oxide; and (2) an alcohol ethoxylate derived from a primary alcohol with preferably 40% branchedchain structure and having from 9 to 15, especially from 12 to 15 carbon atoms in the hydrocarbyl chain, and 3 to 7 moles of ethylene oxide. Another preferred species of the $C_9$–$C_{15}$ ethoxylated alcohol has about 60% branched chain structure.

The Synthetic Anionic Surfactant

The essential synthetic anionic surfactant can be represented by the general formula $R_3SO_3M$ wherein $R_3$ represents a hydrocarbyl group selected from the group consisting of straight or branched alkyl radicals having from 12 to 24 carbon atoms; and alkylphenyl radicals having from 9 to 15 carbon atoms in the alkyl group; and M is a salt-forming cation selected from the group consisting of Na, K, $NH_4$, and mono-, di-, and trialkanol amines having 2 to 3 carbon atoms in the alkanol groups.

The preferred synthetic anionic surfactant of the instant detergent composition is a water-soluble salt of an alkylbenzene sulfonic acid, preferably an alkanolamine alkylbenzene sulfonate, having from about 12 to about 15 carbon atoms in the alkyl group.

More specifically, the preferred synthetic anionic surfactant herein consists of a mono-, di-, or triethanolamine salt of a straight chain alkylbenzene sulfonic acid in which the alkyl group contains in average about 12 carbon atoms.

The preferred alkanolamine alkylbenzene sulfonate salts are prepared by neutralizing the alkylbenzene sulfonic acid with an alkanolamine selected from the group consisting of mono-, di-, triethanolamine and mixtures thereof. The triethanolamine salts are preferred herein.

Specific examples of alkanolamine salts of alkylbenzene sulfonic acids useful in the instant invention include triethanolamine decyl benzene sulfonate, triethanolamine dodecyl benzene sulfonate, diethanolamine undecyl benzene sulfonate, monoethanolamine tridecylbenzene sulfonate, triethanolamine tetradecyl benzene sulfonate, and mixtures thereof.

Other synthetic anionic surfactants useful herein include the organic sulfuric acid reaction products having in their molecular structure an aliphatic hydrocarbon group containing from about 12 to about 24 carbon atoms, or mixture thereof. Examples of this group of synthetic anionic surfactants are the paraffin sulfonates, especially the secondary paraffin sulfonates having in average 13 to 16 carbon atoms; and olefin sulfonates. These anionic surfactants are used in the form of their sodium, potassium, ammonium, but preferably in the form of their mono-, di-, and triethanolamine salts, or mixtures thereof.

The surfactant mixture is used in an amount from about 35% to about 75%, preferably from about 40% to about 55%. Using less than about 35% of the surfactant mixture may lead to stability problems, especially phase stability. The upper limit is dictated by homogeneity reasons, i.e. using substantially more than 75% of the surfactant mixture can create difficulties for incorporating — dissolving — the enzyme component. The weight ratio of ethoxylated nonionic surfactant to synthetic anionic surfactant is normally in the range of from about 1:1 to about 5:1, preferably from about 1:1 to about 3:1.

The Polyacid

Another essential component in the compositions of this invention is a polyacid capable of forming water-soluble calcium complexes; it is used in an amount from about 0.05% to about 1.5% preferably from about 0.05% to about 1.0%, and most preferably from 0.1% to about 0.8%. Preferred polyacid species can be defined by the stability constant of their water-soluble-Ca-complexes and by means of the enzyme stability of detergent compositions containing the polyacid versus what is achieved from an indentical composition wherein the polyacid is citric acid which is present in an amount from 0.3% to 0.6%, preferably 0.5%.

The stability constant qualifies those polyacids, which although capable of providing calcium sequestering power in the detergent composition will leave therein a certain amount of free calcium ions. A total sequestration of the free calcium will lead to deactivation of the enzyme which can be measured in terms of decreased stability of the enzyme, for example, by reference to the enzyme stability in an otherwise identical composition which also contains from 0.3% to 0.6%, preferably 0.5% citric acid.

The water-soluble-Ca-complexes of suitable polyacids have a logarithmic stability constant greater than about 1.5, preferably in the range from about 2.0 to 4.0. These constants are determined at a temperature in the range from 10° C to 40° C. The stability constants are known as "conditional stability constants" of the calcium complexation at a given pH. They can be calculated in accordance with: "COMPLEXATION IN ANALYTICAL CHEMISTRY" by A. Ringbom, Edit. Interscience Publisher. Additional reference is directed to "STABILITY CONSTANTS" published by the London Chemical Society, 1964.

Suitable polyacids are additionally defined by means of the enzyme stability in a composition of this invention versus what is obtained from an identical composition wherein the polyacid is replaced by citric acid at a level of 0.3% to 0.6%, preferably 0.5%. Citric acid is itself a polyacid within the scope of the present invention. It is convenient to include it in the proper amount in a control sample in the test procedure for selecting other operable polyacids. Such a control sample remains clear and homogeneous, whereas in the absence of citric acid or other suitable polyacid, the control sample, which perforce contains some free calcium ions will be cloudy and nonhomogeneous. The liquid detergent compositions of this invention which do not contain a polyacid, can also be used as base-liquid to select, qualitatively and quantitatively, suitable polyacids for use herein. The following description exemplifies the polyacid selection.

A liquid detergent composition is prepared by mixing the following ingredients:

| | in % |
|---|---|
| triethanolamine salt of a linear alkylbenzene sulfonic acid, wherein the alkyl chain averages 11.7 carbon atoms in length | 20 |
| condensation product of branched (72%) fatty alcohol having from 16 to 19 carbon atoms in the alkyl chain and 11 moles of ethylene oxide | 20 |
| condensation product of branched (60%) fatty alcohol having from 12 to 15 carbon atoms in the alkyl chain and 4 moles of ethylene oxide | 10 |
| ethanol | 10 |
| optical brightener (Stilbene type) | 0.25 |
| triethanolamine salt of saturated fatty acid having an average of 16–22 carbon atoms | 0.75 |
| triethanolamine (free) | about 1 to 2 to adjust pH of composition (as is) at pH 7 |
| proteolytic enzyme (commercial enzyme preparation containing 15% pure enzyme) | 0.4 |
| polyacid | see below |
| water | balance to 100% |

The above liquid composition contains about 4 millimoles/liter of the composition of calcium originating mostly from the commercial enzyme preparation with adjustment if needed.

Candidate polyacids for use in this invention and citric acid at a level of e.g. 0.5% are added to separate samples of the above detergent composition. Addition of the candidate polyacid reduces the free calcium ion in the composition by complexation. As explained herein above, candidate polyacids are chosen so that the free calcium ion content in the composition remains within the range of from 0.5 millimoles/liter to 15 millimoles/liter. These samples are submitted to an accelerated storage test at 45° C ± 1° C for 40–60 hours or at 35° C ± 1° C for two weeks. The residual enzymatic activity is analyzed thereby using the method described in: "ANALYST", 96, pages 159–163 (1973), E. DUNN and R. BROTHERTON.

A control sample which does neither contain a polyacid nor citric acid is carried along. A selected polyacid, species and level, is suitable for use in the compositions of this invention if the residual enzymatic activity is of the same order of magnitude as the residual enzymatic activity of the sample containing citric and/or the control which does not contain a polyacid. It is understood that the Ca-complexes of the polyacid are water-soluble i.e. the detergent composition will be substantially free of precipitates and/or cloudiness. The selection technique requires a suitable level of free-calcium in the range from 0.5 to 15 millimoles/liter. Part of the free-calcium serves to achieve enzyme-stability. The minimum enzyme levels claimed, i.e. 0.001%, require less than 0.5 millimole Ca-ions/liter.

The following polyacids were tested in accordance with the procedure described hereinbefore. The storage test conditions were: 35° C — 2 weeks. The residual enzyme stability is calculated by reference to the initial activity for a given sample being 100%.

| Polyacid species | % | Appearance of detergent composition | Residual enzyme activity % | Logarithmic value of stability constant of polyacid Ca-complexes at pH 7 |
|---|---|---|---|---|
| none (control) | 0.0 | cloudy | 65 | not applicable |
| malic acid | 0.5 | cloudy | 80 | 1.0 |
| nitrilotriacetic acid | 0.5 | clear | 75 | 3.5 |
| citric acid | 0.5 | clear | 68 | 3.5 |
| ethylenediamine | 0.5 | clear | 66 | — |

-continued

| Polyacid species | % | Appearance of detergent composition | Residual enzyme activity % | Logarithmic value of stability constant of polyacid Ca-complexes at pH 7 |
|---|---|---|---|---|
| tetramethylene-phosphonic acid | | | | |
| diglycolic acid | 0.2 | clear | 67 | 2.0 |
| tripolyphos-phoric acid | 0.5 | clear | 12 | 4.5 |
| ethylenedia-mine tetraacetic acid | 0.5 | clear | 0 | 7.2 |
| ethylenedia-mine tetraacetic acid | 0.07 | clear | 62 | 7.2 |
| Detergent composition used in selecting suitable polyacids as described above except that the level of total calcium is increased to 8 millimoles/liter: | | | | |
| ethylenediamine tetraacetic acid | 0.25 | clear | 68 | 7.2 |

This data shows that the enzyme stability for a given level of polyacid (0.5%) is inversely related to the logarithmic stability constant of the Ca-polyacid complexes at the pH of the composition. The logarithmic stability constant being a measure of Ca-sequestering ability, it thus can be concluded that relatively strong sequestrants at the given pH shall be incorporated in an amount which will leave a minimum level, as defined herein, of free calcium ions in the composition. Weak sequestrants having a logrithmic stability constant of less than about 1.5, although capable of providing enzyme stability, do not procure a homogeneous (and clear) liquid composition. Strong sequestrants to provide the advantages of this invention need, of course, a higher level of total calcium in the composition.

As is apparent from the above, citric acid can advantageously be used to select, qualitatively and quantitatively, suitable polyacid species.

A broad class of preferred polyacid species for use in the compositions of this invention is comprised of organo-phosphonic acids, particularly alkylene-polyamino-polyalkylene phosphonic acids, inclusive of ethylenediamine tetramethylene phosphonic acid; hexamethylene diaminetetramethylene phosphonic acid, diethylene triaminepentamethylene phosphonic acid; and amino-trimethylene phosphonic acid. Additional preferred polyacid species include: nitrilotriacetic acid; citric acid; and diglycolic acid. Suitable polyacids can be incorporated into the compositions herein in the form of their acids, acid salts or salts.

The Free Calcium Content

The liquid detergent compositions of this invention comprise from 0.5 to 15, preferably from 1.5 to 10 millimoles (m-mol) of free calcium ions per liter of composition. The free calcium ions are either originating from their presence in the additional components of this invention, especially the enzyme preparation, or can be added directly into the compositions. The latter can be achieved by utilizing an aqueous solution of any commonly available calcium salts such a chloride and acetate. The level of free calcium ions can be determined by known methods or can easily be calculated from the logarithmic stbility constant of the polyacid Ca-complex at the pH of the composition.

The Enzyme Component

The essential enzyme component is represented by an alkaline protease having an isoelectric point of greater than about 8. The enzyme is present in an amount from 0.001% to about 2% preferably from about 0.005% to about 0.8%, especially from 0.02% to 0.2%.

The alkaline proteases herein have an iso-electric point greater than about 8 or higher. The iso-electric point, can be determined by electrophoresis on agarose thereby using the technique decribed by R.J. WIEME, in AGAR GEL ELECTROPHORESIS, Elsevier Publ. Comp. 1965. "Greater" with respect to the numerical value of the iso-electric point refers to the absolute value of the iso-electric point. The most preferred proteolytic enzyme preparations for use in this invention are derived from bacillus subtilis such as for example ALCALASE — manufactured by NOVO INDUSTRI A/s, and MAXATASE — manufactured by GIST-PROCADES N.V. The Netherlands. These most preferred enzyme species have an iso-electric point in the range from about 8.5 to about 9.2.

The pH

An essential condition of the present invention is that the compositions have a pH within the range of from 6.0 to 7.5, preferably between about 6.0 and 7.0.

Compositions containing the essential components of the present invention but having a pH below 6.0 can presentt processing difficulties, especially in respect to the incorporation of stilbene-type brightener.

Compositions containing the essential components but having a pH above 7.5 do not anymore provide the full benefits of the invention.

Liquid Carrier

The liquid carrier which is an essential component of the present invention comprises water and a liquid organic solvent. The liquid, organic solvents suitable for use herein, which should not chemically react with any of the components of the instant compositions, are selected from the group consisting of lower aliphatic alcohol having from 2 to 6 carbon atoms and 1 to 3 hydroxyl groups; ethers of diethylene glycol; and mixtures thereof. The organic co-solvent usually represents from 2%–15% by weight of the total composition.

Suitable examples of lower aliphatic alcohols useful in the instant compositions are ethanol, n-propanol, isopropanol and butanol; 1,2-propanediol, 1,3-propnediol, and n-hexanol.

Ethanol and 1,2-propanedol are most preferred. Useful examples of glycol ethers are monomethyl-, ethyl-, propyl-, and monobutyl ethers of diethylene glycol; and mixtures thereof. Other liquid organic solvents having a relatively high boiling point and low vapor pressure could also be used, provided they do not react with any of the other provided they do not react with any of the other ingredients present.

Hydrotropes that can be used in the instant compositions are the watersoluble alkylaryl sulfonates having up to 3 carbon atoms in an alkyl group such as a sodium, potassium, ammonium and ethanol amine salts of xylene-, toluene-, ethylbenzene- and isopropylbenzene sulfonic acids.

They are preferably used in compositions containing, in addition, an organic, synthetic, anionic surfactant of the sulfonate type.

Optional Components

A desirable component for adition herein can be represented by a suitable opacifier. It contributes to create a uniform aesthetical appearance of the compositions of this invention. Examples of suitble opacifiers include polystyrene commercially known as LYTRON 621 and LYTRON 607 manufactured by MONSANTO Chemical Corporation It has been found that the LYTRON opacifiers can be incorporated in the compositions of this invention only in presence of the polyacid i.e., the opacifier precipitates in the compositions herein which do not contain the polyacids.

Optional components include brighteners, fluorescers, antimicrobial agents, suds-regulating agents inclusive of suds-suppressors and suds-boosters, perfumes. Such components preferably comprise not more than about 5% by weight of the total compositions. One particular advantage of the instant compositions is that the hardly water soluble brighteners and fluorescers can be added either directly to the compositions, i.e., as much, or during any step of the formulation process.

The suds-suppressors can be represented by substantially hydrogenated fatty acids having from 16 to 24 carbon atoms in the hydrocarbyl chain, for example, hydrogenated fish oil, and/or by a silicone suds suppressant, Additional examples illustrating the invention are described hereinafter.

| INGREDIENT | Composition (in %) A | B |
|---|---|---|
| triethanolamine salt of a linear alkylbenzene sulfonic acid wherein the alkyl chain averages 11,7 carbon atoms | 20 | 20 |
| condensation product of branched(72%) fatty alcohol having from 16 to 19 carbon atoms in the alkyl chain and 11 moles of ethylene oxide | 20 | — |
| condensation product of branched(60%) fatty alcohol having from 12 to 15 carbon atoms in the alkyl chain and 4 moles of ethylene oxide | 10 | — |
| proteolytic enzyme(MAXATASE, 15% pure enzyme) | 0.4 | 0.4 |
| condensation product of 1:1 blend of $C_{14}$–$C_{15}$ fatty alcohol and 7 moles of ethylene oxide | — | 30 |
| ethanol | 10 | 10 |
| optical brightener (Stilbene type) | 0.25 | 0.25 |
| triethanolamine (free) | 1 to 2 to adjust composition to pH: 7 | pH: 6.5 |
| 9:1 mixture of dimethylpolysiloxane and aerogel silica emulsified in ethoxylated fatty acid(DOW CORNING : DB 31) | 0.1 | 0.2 |
| Water | Balance to 100 | |

These liquid detergent compositions contained 4 millimoles/liter of calcium ions originating from the enzyme preparation.

Samples of above composition A and B were complemented through the addition of a polyacid :

COMPOSITION

-continued

| | A 1 | A 2 | A 3 | B 1 | B 2 | B 3 |
|---|---|---|---|---|---|---|
| citric acid | 0.5 | — | — | 0.50 | — | — |
| ethylenediamine tetramethylene phosphonic acid | — | 0.35 | — | — | 0.35 | — |

After addition of the polyacid, the free calcium ion concentration is reduced but it remains above 0.5 millimoles/liter.

The testing results (accelerated storage 45° C: 36 hours) were as follows:

| | COMPOSITION A 1 | A 2 | A 3 | B 1 | B 2 | B 3 |
|---|---|---|---|---|---|---|
| residual enzyme activity | 42 | 44 | 38 | 66 | 54 | 52 |
| product appearance | clear | clear | cloudy | clear | clear | cloudy |
| performance on bleach-sensitive stains | 4.5 | 4.8 | 3.9 | 3.45 | 4.5 | 2.8 |

The performance on bleach-sensitive stains was assessed by visual examination by reference to a scale from 0 to 5 whereby O indicates no removal and 5 complete removal. The method is fully described in concurrently filed patent application, U.S. Ser. No. 775,214, filed Mar. 7, 1977.

In respect to the above results, it is noteworthy that the performance on bleach-sensitive stains for composition $A_{1;2}$ and $B_{1;2}$ is significantly superior over what is obtaind from $A_3$ and $R_3$ which do not contain the combination of enzyme and polyacid and free calcium ion.

A liquid detergent composition was prepared by mixing the following ingredients:

| Ingredients | Composition A in % |
|---|---|
| triethanolamine salt of linear alkylbenzene sulfonic acid, wherein the alkyl chain averages 11.7 carbon atoms in length | 20 |
| condensation product of branched(72%) fatty alcohol having from 16 to 19 carbon atoms in the alkyl chain and 11 moles of ethylene oxide | 20 |
| condensation product of branched(60%)fatty alcohol having from 12 to 15 carbon atoms in the alkyl chain and 4 moles of ethylene oxide | 10 |
| ethanol | 10 |
| optical brightener (Stilbene type) | 0.25 |
| proteolytic enzyme(commercial enzyme preparation containing 15% pure enzyme) | 0.4 |
| 9:1 mixture of dimethylpolysiloxane and aerogel silica emulsified in $C_{12}$–$C_{16}$ fatty acid - ethoxylated | 0.1 |
| free triethanolamine | 1 to 2 (adjust to pH 7) |
| water | balance to 100 |
| calcium ions | 4 millimoles/liter of composition |

Polyacids were added to composition A in the amounts indicated. The composition was then evaluated for product appearance and residual enzyme active thereby using the techniques applied in the preceeding example.

The testing results were:

| Polyacid | A 1 | A 2 | A 3 |
|---|---|---|---|
| no polyacid | 0 | — | — |
| ethylenediaminetetramethylene phosphonic acid | — | 0.35% | — |
| nitrilotriacetic acid | — | — | 0.75% |

storage : 65 hours at 45° C

-continued

| Polyacid | A 1 | A 2 | A 3 |
|---|---|---|---|
| residual enzyme activity | 24 | 27 | 36 |
| product appearance | cloudy | clear | clear |

Identical compositions were prepared wherein the suds regulating system in addition to the silicone component contained from 0.05% to 1%, preferably from 0.2% to 0.7% of a substantially hydrogenated fatty acid having from 16 to 24 carbon atoms in the fatty alkyl (hydrocarbyl) chain. These compositions comprising the silicone/saturated fatty acid suds regulator do provide the inventive benefits of this invention. The silicone co-suds regulating component is normally present in an amount of up to 0.5%, preferably from 0.01% to 0.2%.

It is noteworthy that in presence of the pre-emulsified silicone/fatty acid suds regulating system, the free-calcium will not react with the fatty acid to thus form unsightly precipitates in the claimed compositions.

The following liquid detergent composition was prepared by mixing the ingredients in the specified amounts.

| Ingredients | Composition (in %) |
|---|---|
| triethanolamine salt of a linear alkylbenzene sulfonic acid wherein the alkyl chain averages 11,7 carbon atoms | 20 |
| condensation product of branched(72%) fatty alcohol having from 16 to 19 carbon atoms in the alkyl chain and 11 moles of ethylene oxide | 20 |
| condensation product of branched(60%) fatty alcohol having from 12 to 15 carbon atoms in the alkyl chain and 4 moles of ethylene oxide | 10 |
| proteolytic enzyme (MAXATASE, 15% pure enzyme) | 0.4 |
| ethanol | 10 |
| optical brightener (Stilbene type) | 0.25 |
| triethanolamine (free) | 1 to 2 to adjust to pH 7 |
| 9:1 mixture of dimethylpolysiloxane and aerogel silica emulsified in highly ethoxylated fatty acid (DOW CORNING : DB 31) | |
| water | balance to 100 |

The finished detergent composition contains 4 millimoles/liter calcium ions originating from the proteolytic enzyme preparation. After addition of the polyacid there remains more than 0.5 millimoles of free calcium ion per liter of composition.

Varying levels of polyacids were added as listed : the residual enzyme activity and the product appearance after 36 hours at 44° C were as follows:

| Polyacid | % | residual enzyme activity (in % of initial activity | Product appearance |
|---|---|---|---|
| Ethylenediaminetetramethylenephosphonic acid (EDTMP) | 0.35 | 49 | clear |
| citric acid | 0.50 | 36 | clear |
| EDTMP + | 0.3 | | |
| citric acid | 0.2 | 58 | clear |
| none | — | 33 | cloudy |

A liquid detergent composition according to this invention was prepared by mixing the following ingredients:

| Ingredient | Composition (in%) |
|---|---|
| linear alkyl benzene sulfonic acid (alkyl chain averages 11,7 carbon atoms in length) | 13.7 |
| triethanolamine | 8.5 |
| condensation product of branched (72%) fatty alcohol having from 16 to 19 carbon atoms in the alkyl chain, and 11 moles of ethylene oxide | 20.0 |
| condensation product of branched (60%) fatty alcohol having from 12 to 15 carbon atoms in the alkyl chain and 4 moles of ethylene oxide | 10.0 |
| proteolytic enzyme (Maxatase-containing 1,5 Anson unit/gram) | 1.0 |
| ethanol | 10.0 |
| $C_{18}$–$C_{24}$ saturated fatty acid | 0.5 |
| 9:1 mixture of dimethylpolysiloxane and aerogel silica emulsified in ethoxylated fatty acid | 0.1 |
| total calcium | see below |
| polyacid | see below |
| water and minors inclusive of pH 7 regulator and brightener | balance to 100 |

The compositions of this invention were completed by adding polyacids and by adjusting the total calcium to reach the levels indicated. The free calcium ion content after addition of polyacid is in between 0.5 millimoles/liter and 15 millimoles/liter.

| | POLYACID | % | TOTAL CALCIUM (millimoles) |
|---|---|---|---|
| a) | no | — | 4 |
| b) | no | — | 8 |
| c) | Citric acid | 1 | 10 |
| d) | Citric acid | 0.5 | |
| | EDTMP | 0.5 | 6 |
| e) | EDTMP | 1 | 5 |
| f) | Citric acid | 0.5 | 5 |

It was found that the compositions of this invention (c to f) were free of precipitates whereas prior art compositions were cloudy. The residual enzymatic activity (under accelerated storage conditions 2 weeks; 35° C) of inventive compositions c-f was significantly superior over what was found for compositions a and b.

What is claimed is:

1. An unbuilt enzymatic liquid detergent composition comprising:

(a) from about 35% to about 75% by weight of the composition of a surfactant mixture which is (i) an ethoxylated nonionic surfactant selected from the group consisting of ethoxylated aliphatic alcohols and ethoxylated alkyl phenols and mixtures thereof, and (ii) a synthetic anionic surfactant selected from the group consisting of compounds of the formula $R_3SO_3M$, wherein $R_3$ represents a hydrocarbyl group selected from the group consisting of straight or branched chain alkyl radicals having from 12 to 24 carbon atoms; and alkyl phenyl radicals having from 9 to 15 carbon atoms in the alkyl group and wherein M is a salt forming cation selection from the group consisting of sodium, potassium, ammonium, and mono-, di-, and trialkanol amines having 2 to 3 carbon atoms in the alkanol group, wherein the weight ratio of said ethoxylated nonionic surfactant to said synthetic anionic surfactant is from about 1:1 to about 5:1;

(b) from about 0.05% to about 1.5% by weight of a polyacid selected from the group consisting of:

ethylenediamine tetramethylene phosphonic acid; hexamethylene diaminetetramethylene phosphonic acid, diethylene triaminepentamethylene phosphonic acid, and aminotrimethylene phosphonic acid;

(c) from 0.5 millimole to 15 millimoles/liter of composition of free calcium ions;

(d) from 0.001% to about 2% by weight of an alkaline proteolytic enzyme having an iso-electric point of greater than about 8; and (e) the balance of the composition comprising a liquid which is water and a liquid organic solvent which is a lower aliphatic alcohol having from 2 to 6 carbon atoms and 1 to 3 hydrocarbyl groups and mixtures thereof wherein the liquid organic solvent is from about 2% to about 15% by weight of the total composition and wherein the pH of the composition is from about 6.0 to about 7.5.

2. A composition in accordance with claim 1 wherein said surfactant mixture is present in an amount from about 40% to about 55% by weight, the weight ratio of said ethoxylated nonionic surfactant to said synthetic anionic surfactant being in the range from about 1:1 to about 3:1.

3. A composition in accordance with claim 1 wherein the proteolytic enzyme is present in an amount from 0.005% to about 0.8% by weight.

4. A composition in accordance with claim 1 wherein the ethoxylated nonionic surfactant is a mixture of:

(1) an alcohol ethoxylate derived from a primary alcohol having at least 65% branched-chain structure and from about 16 to 19 carbon atoms in the hydrocarbyl chain, and from 8 to 14 moles of ethylene oxide; and (2) an alcohol ethoxylate derived from a primary alcohol having from about 12 to 15 carbon atoms in the hydrocarbyl chain, and from 3 to 7 moles of ethylene oxide.

5. A composition in accordance with claim 1 which further comprises a suds regulating system consisting of:

(a) from 0.01% to 0.2% by weight of silicone; and (b) from 0.05% to 1% by weight of a saturated fatty acid having from about 16 to about 24 carbon atoms in the fatty acid chain.

6. An unbuilt enzymatic liquid detergent composition according to:

(a) from about 40% to about 55% by weight of a surfactant mixture containing an ethoxylated nonionic surfactant and a synthetic anionic surfactant, wherein:

(i) the ethoxylated nonionic surfactant is a mixture of:

($\alpha$) an alcohol ethoxylate derived from a primary alcohol having at least 65% branched-chain structure and having from about 16 to 19 carbon atoms in the hydrocarbyl chain, and from 8 to 14 moles of ethylene oxide;

($\beta$) an alcohol ethoxylate derived from a primary alcohol having from 12 to 15 carbon atoms in the hydrocarbyl chain, and from 3 to 7 moles of ethylene oxide; and (ii) the synthetic anionic surfactant is selected from the group consisting of the mono-, di-, and trialkanol amine alkyl benzene sulfonates having from about 12 to about 15 carbon atoms in the alkyl group, and mixtures thereof, whereby the weight ratio of the ethoxylated nonionic surfactants to the synthetic anionic surfactant is from about 1:1 to about 3:1, (b) from about 0.1% to about 0.8% by weight of a polyacid selected from the group consisting of: ethylenediamine tetramethylene phosphonic acid, hexamethylene diamine tetramethylene phosphonic acid, diethylene tri - aminepentamethylene phosphonic acid, and aminotrimethylene phosphonic acid;

(c) from 1.5 millimole to 10 millimoles/liter of composition of free calcium ions;

(d) from 0.02% to about 0.2% by weight of an alkaline proteolytic enzyme having an iso-electric point of greater than about 8; and (e) a suds regulating system consisting of:

(i) from 0.01% to 0.2% by weight of silicone; and (ii) from 0.05% to 1% by weight of a saturated fatty acid having from about 16 to 24 carbon atoms in the fatty alkyl chain;

(f) the balance of the composition comprising a liquid which is water and a liquid organic solvent which is a lower aliphatic alcohol having from 2 to 6 carbon atoms and 1 to 3 hydrocarbyl groups and mixtures thereof wherein the liquid organic solvent is from about 2% to about 15% by weight of the total composition and wherein the pH of the composition is from about 6.0 to about 7.0.

* * * * *

UNITED STATES PATENT AND TRADEMARK OFFICE

CERTIFICATE OF CORRECTION

PATENT NO. : 4,111,855

DATED : September 5, 1978

INVENTOR(S) : Christian Roland Barrat et al

It is certified that error appears in the above-identified patent and that said Letters Patent are hereby corrected as shown below:

Column 14, line 60, "selection" should be --selected--.

Column 15, line 49, "according to" should be --comprising--.

Signed and Sealed this

*Thirteenth* Day of *February 1979*

[SEAL]

*Attest:*

RUTH C. MASON
*Attesting Officer*

DONALD W. BANNER
*Commissioner of Patents and Trademarks*